US007077685B2

(12) United States Patent
Fukaya et al.

(10) Patent No.: US 7,077,685 B2
(45) Date of Patent: Jul. 18, 2006

(54) CONNECTOR, A MATING CONNECTOR AND A CONNECTOR ASSEMBLY

(75) Inventors: Tomoyoshi Fukaya, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/977,666

(22) Filed: Oct. 29, 2004

(65) Prior Publication Data

US 2005/0095898 A1 May 5, 2005

(30) Foreign Application Priority Data

Oct. 30, 2003 (JP) ..... 2003-370777

(51) Int. Cl.
*H01R 13/627* (2006.01)

(52) U.S. Cl. ..... 439/354; 439/358

(58) Field of Classification Search ..... 439/354, 439/350, 352, 357, 358, 345
See application file for complete search history.

(56) References Cited

U.S. PATENT DOCUMENTS

| | | | | |
|---|---|---|---|---|
| 5,380,217 | A * | 1/1995 | Yagi et al. | 439/358 |
| 5,711,684 | A * | 1/1998 | Inoue et al. | 439/354 |
| 5,782,647 | A * | 7/1998 | Okura et al. | 439/358 |
| 6,217,365 | B1 * | 4/2001 | Shinozaki | 439/358 |
| 6,325,656 | B1 * | 12/2001 | Fukuda et al. | 439/358 |
| 6,527,579 | B1 | 3/2003 | Sato et al. | 439/382 |
| 6,786,756 | B1 * | 9/2004 | Mase et al. | 439/358 |

* cited by examiner

*Primary Examiner*—Hien Vu
(74) *Attorney, Agent, or Firm*—Gerald E. Hespos; Anthony J. Casella

(57) ABSTRACT

A connector (M) has a fitting (21) with an open front end for receiving a mating connector (F). The fitting (21) includes a bottom wall (22), sidewalls (23) and a top wall (24). The top wall (24) is recessed at the front end to form a notch (25) between top edges (23*a*) of the sidewalls (23). Extensions (27) extend obliquely up and in from the top edges (23*a*) of the sidewalls (23) in areas corresponding to the notch (25). The oblique alignment of the extensions (27) ensures that forces exerted by a mating connector (F) will deform the extensions (27) and the sidewalls (23) uniformly without damaging the fitting (21).

5 Claims, 6 Drawing Sheets

CONNECTOR, A MATING CONNECTOR AND A CONNECTOR ASSEMBLY

BACKGROUND OF THE INVENTION

1. Field of the Invention

The invention relates to a connector, a mating connector therefor and to a connector assembly.

2. Description of the Related Art

U.S. Pat. No. 6,527,579 discloses a connector with a fitting that has a bottom wall, sidewalls that extend up from the left and right edges of the bottom wall and an upper wall that bridges the upper ends of the opposite side walls. A locking hole is formed in the upper wall. A mating connector can be fit into the fitting. The mating connector has an upper surface with a lock arm that engages the locking hole to lock the two connectors together.

An unlocking portion projects up from the lock arm of the mating connector and a notch is recessed in the front edge of the upper wall of the fitting to avoid interference with the unlocking portion. However, the front ends of the sidewalls corresponding to the notch are not coupled to each other. Thus, there is a possibility that the sidewalls will deform transversely inward or outward in response to an external force. Further, the front end of the mating connector may contact the back end of the notch if the mating connector is fit too high into the fitting, and thus the connecting operation may be hindered.

Consideration has been given to providing inwardly projections on the upper edges of the sidewalls. These projections would increase the rigidity at the upper front edges of the sidewalls and could prevent the transverse deformation of the sidewalls. Further, the inward projections on the sidewalls would position the mating connector vertically at the front end of the fitting, and hence a smooth connecting operation could be provided. However, the notch formed at the front end of the upper wall would permit the mating connector to be lifted up while being fit lightly into the fitting. As a result, the lateral edges of the upper surface of the mating connector could catch the projections. A strong lifting force on the mating connector at this time could damage the sidewalls and the projections.

The invention was developed in view of the above problems and an object thereof is to improve overall strength of a connector.

SUMMARY OF THE INVENTION

The invention relates to a connector with a fitting that has a bottom wall. First and second sidewalls extend up from opposite side edges of the bottom wall and a top wall bridges over the top edges of the sidewalls. The terms top and bottom are used herein as a convenient frame of reference, and are not intended to imply a required gravitational orientation. A mating connector can be fit into the fitting from the front and substantially along a connecting direction. A notch is formed in the front edge of the top wall, and at least one extension extends in at an area of an edge of at least one sidewall corresponding to the notch. The extension extends obliquely in and up away from the bottom wall with respect to the second and/or third walls. The mating connector can deform the extension and the sidewall out while sliding on the inclined inner surface of the extension to come out upward past the extension when an upward pushing force acts on the mating connector. Thus, the mating connector is displaced and escapes without being caught by the connector, and there is little or no likelihood of damaging the extension and the sidewall.

The front end surface of the extension preferably is substantially flush with and continuous with the front end of the corresponding sidewall. Thus, the extension efficiently guides the mating connector at the front end of the fitting and at the initial stage of the connection. Further, the front end of the extension could be damaged by interference with the mating connector or with external matter if the front end of the extension projected more forward than the front end surface of the sidewall. However, the front end surface of the extension of the subject invention is substantially flush with front end of the corresponding sidewall. Thus, there is no likelihood of damaging the front end of the extension.

The rear end of the extension preferably is continuous with the front end of the side edge of the top wall.

A rear end of the extension could easily displace outward if the rear end of the extension was distanced from the front end of the top wall. However, the area of the upper edge of the sidewall corresponding to the rear end of the extension would be continuous with the upper wall, and hence would be difficult to displace outward. Thus, only the rear end of the extension would displace excessively out in response to a pushing force exerted by the mating connector on the extension. Contrary to this, the rear end of the extension is substantially continuous with the front end of the side edge of the top wall and is difficult to displace outward similar to the sidewall according to the present invention. Therefore, there is no likelihood that only the rear end of the extension will displace excessively outward.

A substantially constant distance preferably exists between the distal edges of the sidewalls and the distal edges of the extensions from the front ends to the rear ends of the extensions.

The extensions preferably are aligned at about 15°–20° to the sidewalls.

The invention also relates to a connector assembly comprising the above-described connector and a mating connector. The mating connector preferably has slanted surfaces for engaging the extensions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
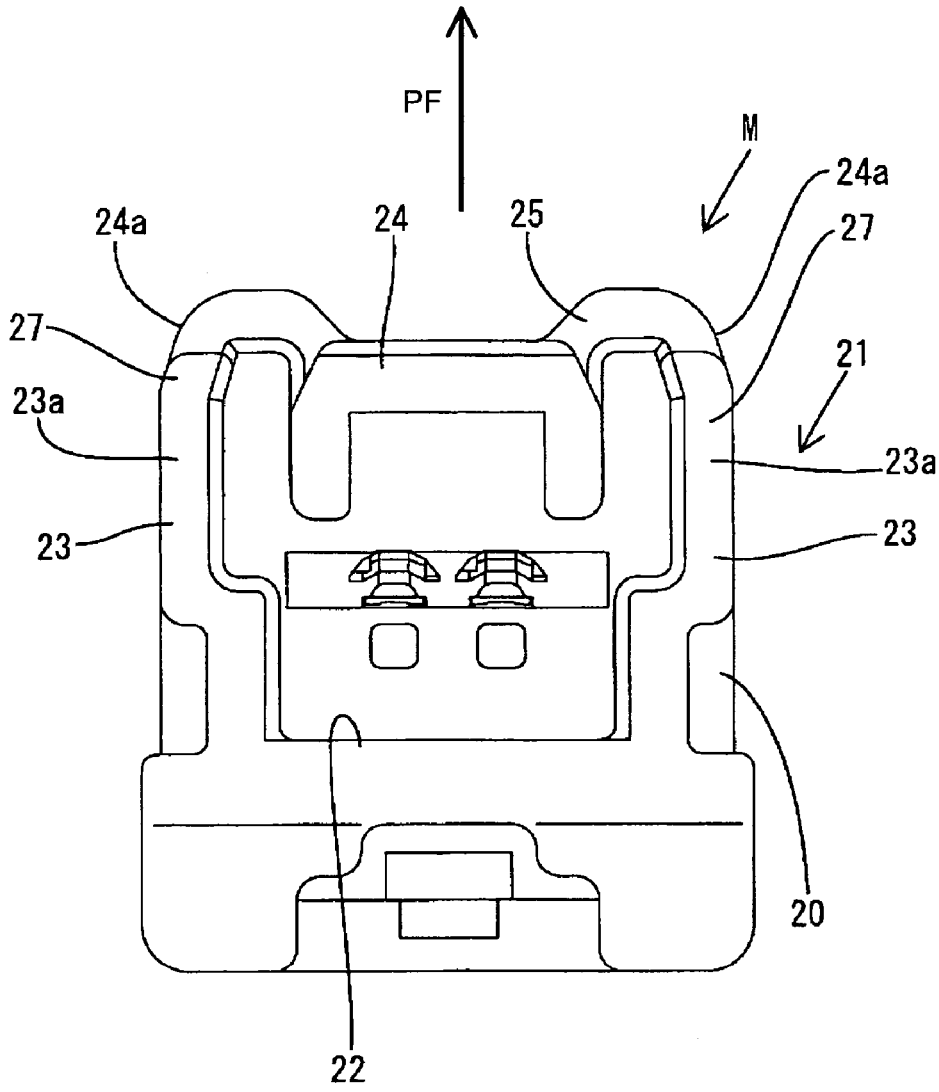
FIG. 1 is a front view of a male connector according to one embodiment of the invention.
Figure 2:
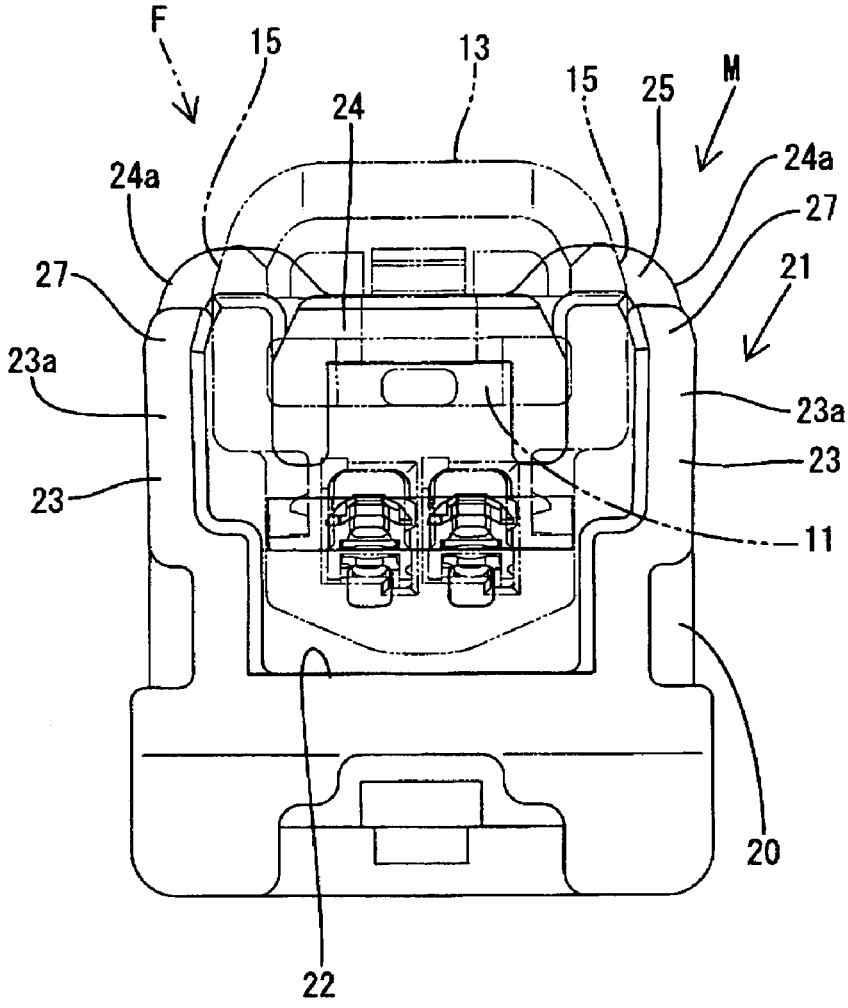
FIG. 2 is a front view showing an upward displacing process of a mating female connector.
Figure 3:
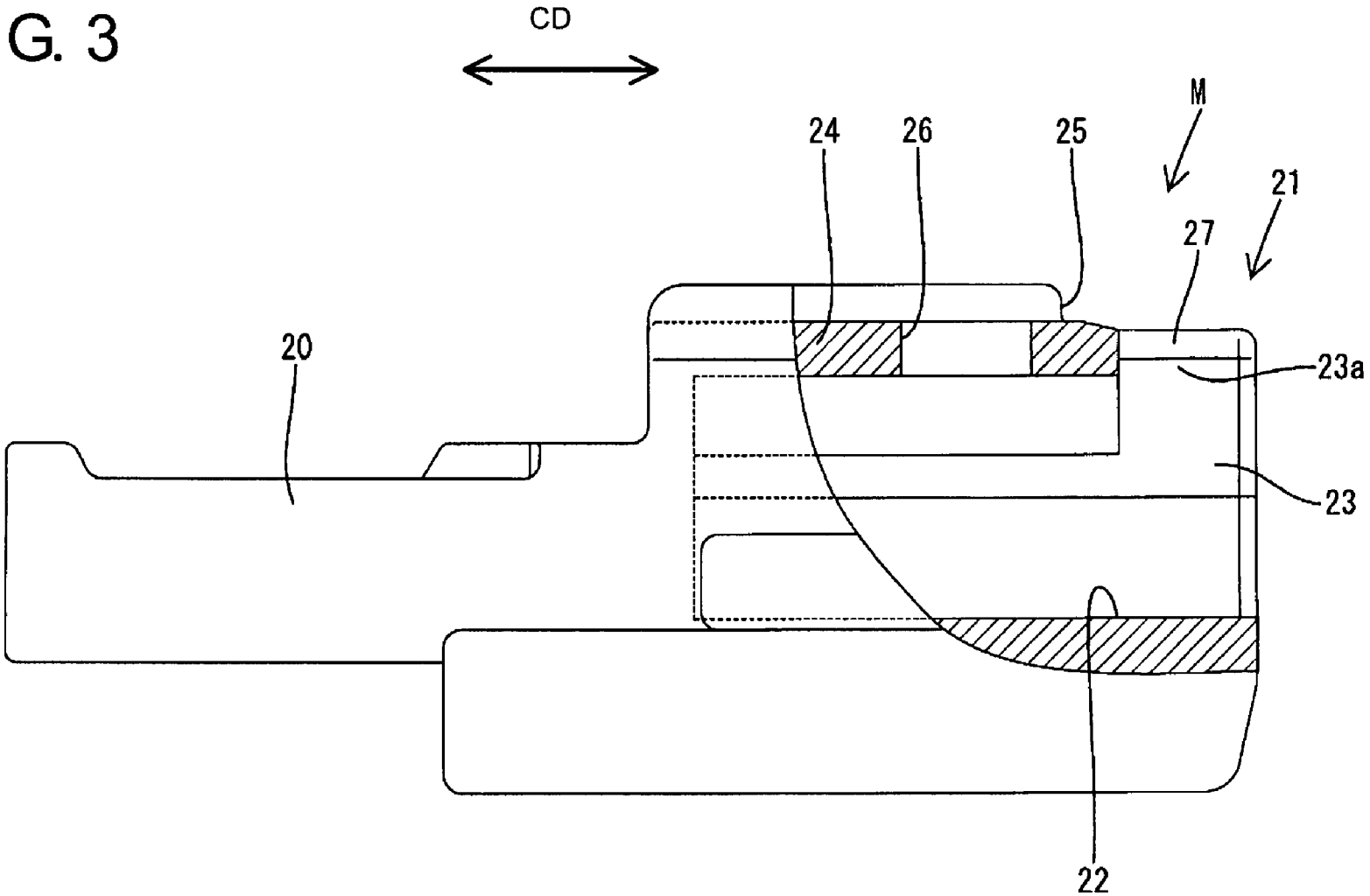
FIG. 3 is a side view partly in section of the male connector.
Figure 4:
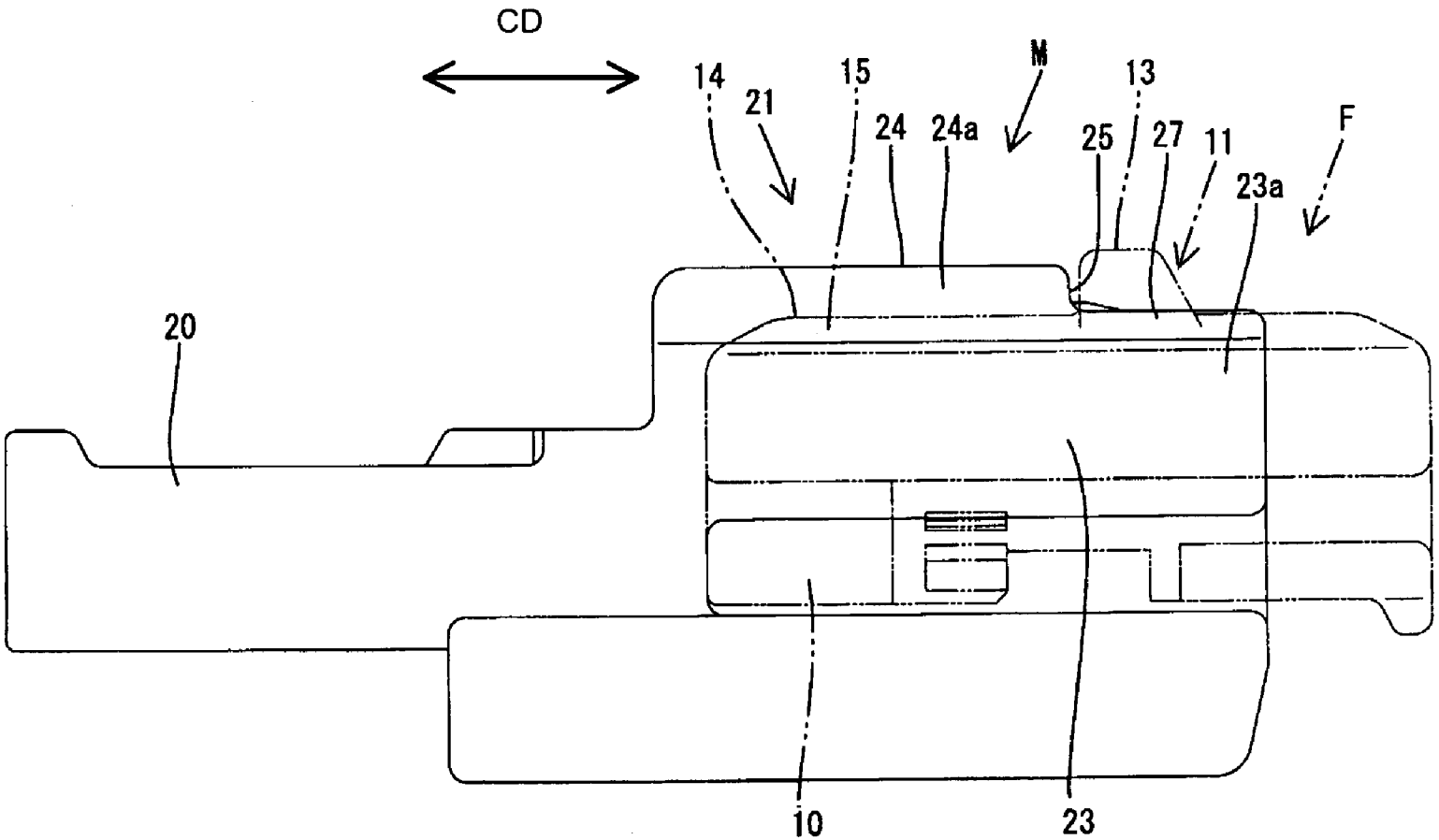
FIG. 4 is a side view showing the mating female fitted.
Figure 5:
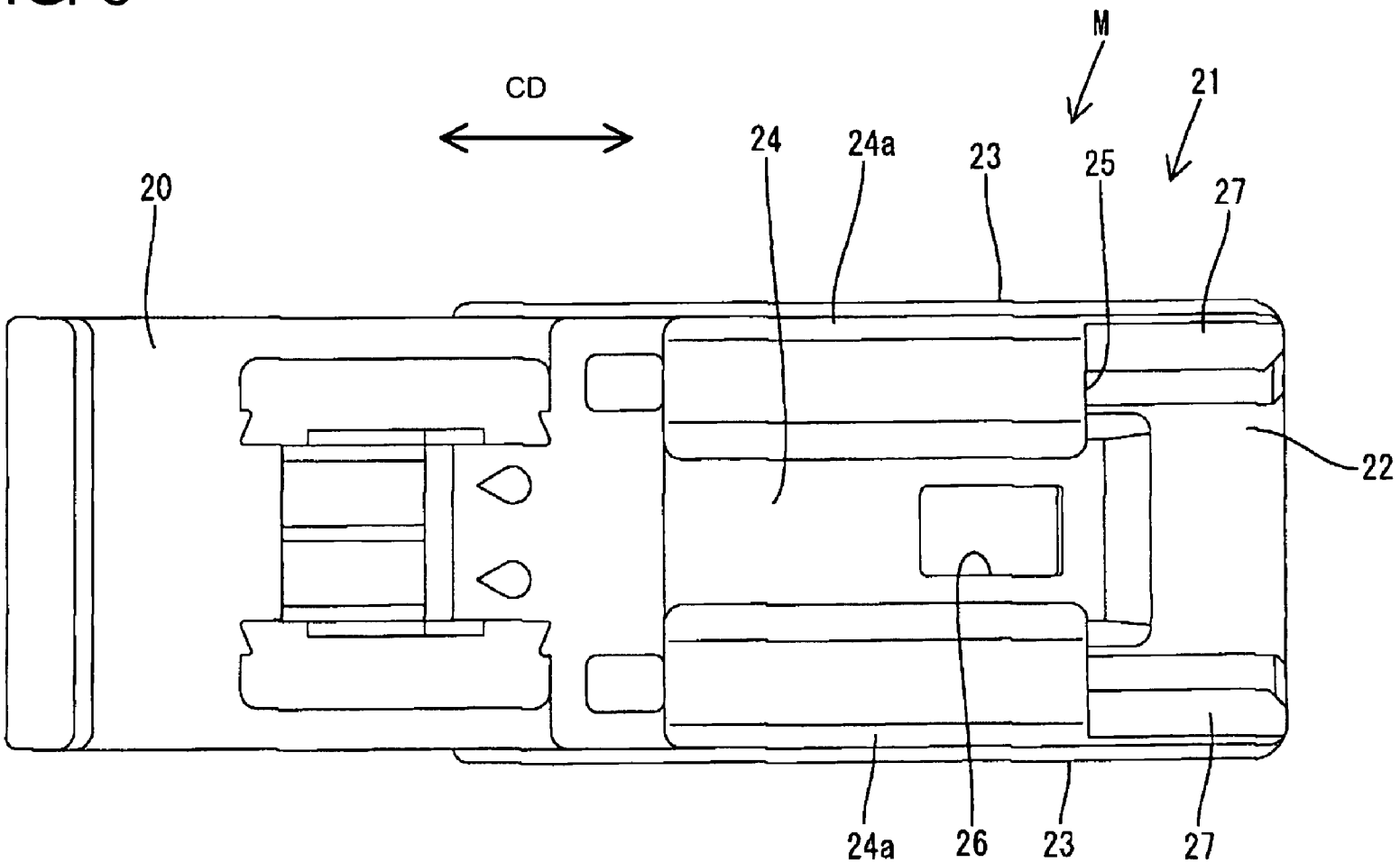
FIG. 5 is a plan view of the male connector.
Figure 6:
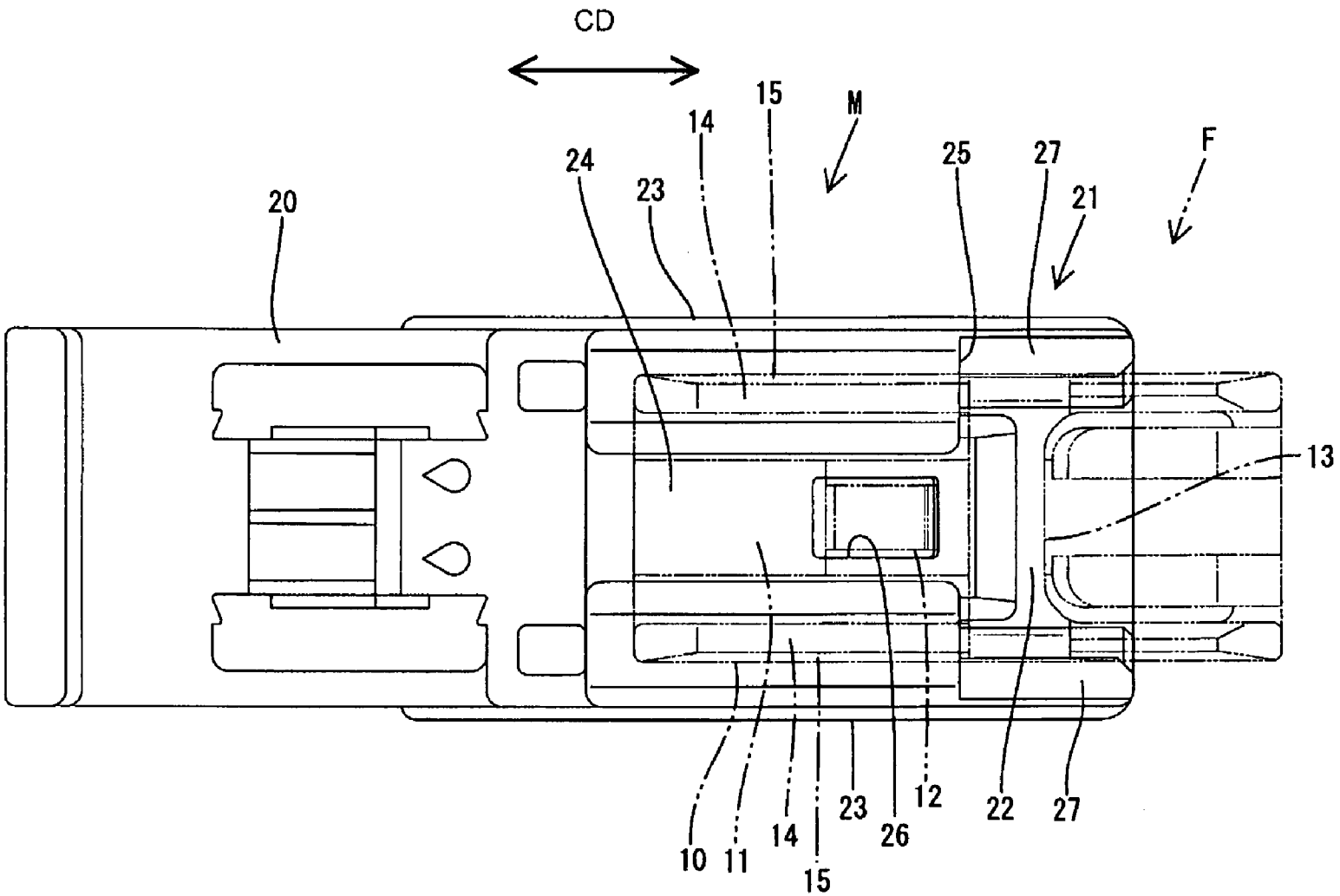
FIG. 6 is a plan view showing a state where the mating female connector is fitted.

A male connector according to the invention is identified by the letter M in FIGS. 1 to 6. The male connector M is configured to receive a female connector F along a connecting direction CD. The terms upper and lower are used herein as a convenient frame of reference, but are not intended to imply a required gravitational orientation.

The female connector F has a female housing 10 formed from a synthetic resin and is configured to receive unillustrated female terminal fittings. A lock arm 11 is formed unitarily on the upper surface of the female housing 10. The lock arm 11 is cantilevered backward (rightward in FIGS. 4 and 6) and is vertically deformable. A lock projection 12 is formed on the upper surface of the lock arm 11 slightly before the rear end of the upper surface. An unlocking portion (not shown) is formed at the rear of the upper surface of the lock arm 11 for unlocking the lock arm 11. Protection walls 14 are formed at opposite left and right edges of the upper surface of the female housing 10 and at left and right sides of the lock arm 11. A cover 13 bridges the upper ends of the protection walls 14 for at least partly covering the unlocking portion from above. Further, slanted surfaces 15 are formed at the upper ends of the transversely outer surfaces of the protection walls 14.

The male connector M includes a male housing 20 made e.g. of a synthetic resin and configured to receive unillustrated male terminal fittings. A fitting 21 opens forward (rightward in FIGS. 3 to 6) at a front portion of the male housing 20. The female housing 10 of the female connector F is fittable into fitting 21 from the front and along the connecting direction CD.

The fitting 21 has a bottom wall 22. Substantially plate-shaped sidewalls 23 extend up from the opposite left and right edges of bottom wall 22, and a substantially horizontal upper wall 24 bridges the upper edges of the sidewalls 23. The front end of the upper wall 24 is recessed back over substantially the entire width to form a notch 25. The cover 13 of the lock arm 11 is located in the notch 25 when the connectors F, M are connected with each other. Thus, the notch 25 avoids interference with the cover 13. Further, a substantially rectangular locking hole 26 vertically penetrates the upper wall 24 at a position slightly behind the rear edge of the notch 25. The lock projection 12 engages the locking hole 26 to lock the two connectors F, M together. The two connectors F, M are separated by pushing down the cover 13 located in the notch 25 to deform the lock arm 11 down and in, thereby disengaging the lock projection 12 from the locking hole 26 to cancel a locked state. The connectors F, M are pulled apart while keeping this unlocked state.

The upper wall 24 does not couple front-upper end areas 23*a* of the sidewalls 23. Thus, the front-upper end areas 23*a* may possibly deform and curve out or in. The front end of the female housing 10 may enter a space between the opposite sidewalls 23 when the female housing 10 is fit into the fitting 21 and may be held higher than a proper position at an initial stage of a connecting operation. As a result, the upper edge of the front end of the female housing 10 may contact the front edge of the upper wall 24 at the rear edge of the notch 25.

To avoid these potential problems, transversely symmetrically extensions 27 are formed on the opposite sidewalls 23 and serve as a reinforcing means for enhancing the rigidity of the front-upper end areas 23*a* of the sidewalls 23 and as a guiding means for positioning the female housing 10 at a proper height during the initial stage of the connecting operation. The extensions 27 extend obliquely in towards the top from the upper edges of the front-upper end areas 23*a* of the sidewalls 23, and hence from the left and right edges of the notch 25. Additionally, the extensions 27 extend forward and back over substantially the entire area from the front end to the rear end of the notch 25. Distal ends of the extensions 27 approach each other due to their oblique alignment. The extensions 27 are substantially continuous forward and back along the connecting direction CD. Accordingly, the front end surfaces of the extensions 27 are substantially flush with the front end surfaces of the sidewalls 23 and the rear ends of the extensions 27 are substantially continuous with the front ends of the side edges of the upper wall 24. A dimension from the upper edges of the sidewalls 23 to the upper edges of the extensions 27 is substantially constant from the front ends to the rear ends of the extensions 27. The extensions 27 preferably are aligned at about 15° to about 20° to the sidewalls 23 in this embodiment, but other angles may be employed. Opposite side edges of the upper wall 24 are formed into slanted portions 24*a* that slope down and out to be substantially flush with the extensions 27.

The extensions 27 extend obliquely up and in with respect to the sidewalls 23. The female connector F could exert an upward-pushing force PF on the extensions 27. This pushing force PF will deform the extensions 27 and the sidewalls 23 outwardly. As a result, the female connector F will slide on the inclined inner surfaces of the extensions 27 to come out upward past the extensions 27. In other words, the extensions 27 are displaced to escape from the female connector F without being caught by the female connector F. Accordingly, the extensions 27 and the sidewalls 23 are not likely to be damaged or broken when the extensions 27 receive an upward-pushing force PF from the female connector F.

The front end surfaces of the extensions 27 are substantially flush with the front end surfaces of the sidewalls 23. Thus, the extensions 27 guide the female housing F and vertically position the female housing F at the front end of the fitting 21 during the initial stage of the connecting operation. Therefore, the extensions 27 provide a good guiding performance.

Extensions that projected more forward than the front ends of the sidewalls could be broken or damaged by interference with the female connector or external matter. However, the front end surfaces of the extensions 27 are substantially flush with the front ends of the sidewalls 23. Thus, there is no likelihood that the front ends of the extensions 27 are broken or damaged.

The rear ends of the extensions conceivably could be spaced from the front end of the upper wall. Rear ends of the extensions on this hypothetical connector would be easy to displace outward, whereas upper parts of the sidewalls corresponding to the rear ends of the extensions would be difficult to displace outward because they are continuous with the upper wall, thereby presenting a considerable difference in rigidity. Thus, only the rear ends of the extensions would be displaced excessively outward in response to a pushing force PF exerted by the female connector F on these extensions.

Contrary to this, the rear ends of the extensions 27 of the subject invention are substantially continuous with the front ends of the side edges of the upper wall 24 and are difficult to displace outward. Thus, the extensions 27 have rigidity characteristics similar to the sidewalls 23 in this embodiment. More particularly, the rigidity of the rear ends of the extensions 27 is enhanced to the same extent as the rigidity of the front-upper end areas 23*a* of the sidewalls 23. Therefore, there is no likelihood that only the rear ends of the extensions 27 will displace excessively outward.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Both left and right extensions are oblique in the foregoing embodiment. However, only one of them may be oblique. In such a case, the other extension may be at a substantially right angle to the sidewall.

Although the extension is provided at each of the left and right sides in the foregoing embodiment, it may be provided only at one side.

The left and right extensions have the same angle of inclination in the foregoing embodiment, but they may have different angles of inclination.

The front end surfaces of the extensions are substantially flush with the front ends of the sidewalls in the foregoing embodiment. However, they may be behind or before the front end surfaces of the sidewalls.

The rear ends of the extensions are substantially continuous with the top wall in the foregoing embodiment. However, a clearance may be defined along the connecting direction CD between the rear ends of the extensions and the front edge of the top wall according to the invention.

The extending distance of the extensions from the upper edges of the sidewalls is substantially constant from the front end to the rear end of the extensions in the foregoing embodiment. However, the extending distance may differ between the front and rear ends of the extensions or may increase and/or decrease gradually or non-regularly from the front end towards the rear ends.

What is claimed is:

1. An electrical connector with a fitting having opposite front and rear ends, the fitting comprising:

a plurality of terminals positioned in the fitting;

a bottom wall extending rearward from the front end towards the rear end thereof;

opposed substantially parallel first and second sidewalls extending up from opposite sides of the bottom wall and extending from the front end towards the rear end thereof;

a top wall extending between top edges of the first and second sidewalls rearward from the front end of the fitting; and first and second extensions extending obliquely up and in from the top edges of the respective first and second sidewalls forward from a front end of the top wall, the extensions converging towards one another at farther distances from the bottom wall and having front ends substantially flush with front ends of the sidewalls at the front end of the fitting, a notch being defined between the first and second extensions and extending from a portion substantially adjacent a front edge of the top wall.

2. The connector of claim 1, wherein the top wall has a central portion spaced from the sidewalls and aligned substantially parallel to the bottom wall, the top wall further having first and second slanted portions extending angularly between the central portion of the top wall and the respective first and second sidewalls.

3. The connector of claim 2, wherein the first and second slanted portions of the top wall are substantially coplanar with the respective first and second extensions.

4. The connector of claim 3, wherein dimensions from distal edges of the first and second extensions to the respective first and second sidewalls is substantially constant over an entire area from front ends to rear ends of the extensions.

5. The connector of claim 4, wherein each of the first and second extensions is aligned at an angle of about 15° to about 20° to the respective first and second sidewall.

* * * * *